US006878101B2

(12) United States Patent
Colley

(10) Patent No.: US 6,878,101 B2
(45) Date of Patent: Apr. 12, 2005

(54) TREADMILL WITH ADJUSTABLE PLATFORMS

(76) Inventor: George Lee Colley, 19326 Snowden, Detroit, MI (US) 48235

( * ) Notice: Subject to any disclaimer, the term of this patent is extended or adjusted under 35 U.S.C. 154(b) by 45 days.

(21) Appl. No.: 10/453,288

(22) Filed: Jun. 4, 2003

(65) Prior Publication Data

US 2004/0248699 A1 Dec. 9, 2004

(51) Int. Cl.[7] ..... A63B 22/02
(52) U.S. Cl. ..... 482/54
(58) Field of Search ..... 482/51–54, 57, 482/70, 79–80, 148

(56) References Cited

U.S. PATENT DOCUMENTS 5,224,909 A * 7/1993 Hamilton ..... 482/70
5,429,563 A * 7/1995 Engel et al. ..... 482/54
5,492,521 A 2/1996 Wilkinson et al.
5,626,539 A 5/1997 Plaget et al.
5,669,856 A 9/1997 Liu
5,860,894 A 1/1999 Dalebout et al.
D406,621 S 3/1999 Piaget
5,921,892 A * 7/1999 Easton ..... 482/54
6,033,347 A 3/2000 Dalebout et al.
6,443,875 B1 9/2002 Golen, Jr. et al.

* cited by examiner

*Primary Examiner*—Stephen R. Crow

(57) ABSTRACT

A treadmill includes a plurality of platforms spaced apart and disposed on opposite sides of a base. The plurality of platforms each is selectively operable by a motor-driven assembly. The plurality of platforms can be independently operated for allowing a user to place one leg thereon while exercising the other leg on the treadmill belt. A seat is removably positionable to opposite sides of the base so that a user may rest thereon when operating the treadmill. A display screen is attached to a control panel and movable therebeneath when the treadmill is folded to a non-operating position.

20 Claims, 6 Drawing Sheets

TREADMILL WITH ADJUSTABLE PLATFORMS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a treadmill and, more particularly, to a treadmill including a plurality of adjustable platforms for allowing a user to exercise one leg at a time similar to riding a conventional scooter. Applicant's previously submitted documents assigned Document Disclosure No. 484284 are incorporated herein by reference.

2. Prior Art

Treadmills have become increasingly popular in recent years as a piece of exercise equipment. Treadmills can be used for either running or walking indoors such as in the home or office. Most exercise treadmills include an exercise platform that includes an elongated frame with a first and second roller assembly mounted across opposite lateral ends of the frame. An endless belt is mounted for travel about the roller assemblies. The belt is flexible for supporting the weight of the user. A deck that is disposed between the upper portion of the belt and the frame usually supports the belt. The deck is usually made of rigid material. A motor controls the belt. As the user walks or runs on the belt, the belt is pressed against the underlying deck to provide mechanical support for a user.

Conventional treadmills require a user to walk on the treadmill belt with both feet. This requires a user to exercise both legs at the same time, rather than exercising one leg at a time. Exercising one leg at a time is beneficial for users undergoing rehabilitation to retrain the muscles in the leg. Further, users recovering from injuries and surgeries, as well as those who may be undergoing physical therapy require treadmills that allow them to exercise one leg at a time for helping them regain strength and improve balance and coordination in the lower extremities.

Accordingly, there exists a need for a treadmill that allows a user to exercise one leg at a time.

BRIEF SUMMARY OF THE INVENTION

In view of the foregoing background, it is therefore an object of the present invention to provide a treadmill for allowing a user to exercise one leg at a time. These and other objects, features, and advantages of the invention are provided by a treadmill including a control panel for receiving user input, a plurality of side posts including respective upper portions connected to the control panel and extending downwardly therefrom to ground level. The side posts further include respective lower portions.

The treadmill further includes a base including a front end connected between the pair of side posts and extending rearwardly from the respective lower portions thereof, a treadmill belt connected to the base and being selectively operable by a user, means for selectively operating the treadmill belt and being connected to the base and a plurality of platforms space apart and disposed on opposite sides of the base. The plurality of platforms have opposed end portions. The treadmill further includes means for selectively operating the plurality of platforms and being connected to the base.

A plurality of handrails include rearward ends respectively and are preferably connected to the upper portion of each side post and extend rearwardly therefrom. A towel holder is preferably connected to the upper portion of one side post and extends laterally therefrom. A handle is preferably connected to the control panel and extends upwardly therefrom. A magazine holder is preferably attached to the control panel and extends upwardly therefrom. A display screen is preferably connected to the control panel and for displaying visual data and symbols corresponding to an operating mode of the treadmill.

The control panel may include a button communicating therewith and for automatically stopping the treadmill when pressed by a user. The control panel may further include a button communicating therewith for selectively moving the treadmill between open and closed positions. The control panel may further include a button communicating therewith for toggling the treadmill between operating and non-operating modes.

The treadmill preferably includes a plurality of linking members having opposite ends attached generally medially of the plurality of side posts and the rearward ends of the plurality of hand rails respectively. The plurality of linking members each has first and second elongate portions connected at respective ends. The first and second members are movable between bent and extended positions when the plurality of hand rails are moved between corresponding non-operable and operable positions.

The treadmill preferably includes a plurality of brackets for connecting the front end of the base to the lower portions of the plurality of side posts respectively. The base is preferably pivotable at the bracket for moving the base between operable and non-operable positions. A plurality of wheels is preferably connected to the lower portions of the plurality of side posts respectively so that the treadmill can be rolled thereon.

The means for selectively operating the plurality of platforms preferably includes a plurality of drive motors, a plurality of gears connected to the plurality of drive motors respectively, a plurality of elongate worm gears connected to the plurality of gears respectively, a plurality of couplings movably disposed along a length of the plurality of worm gears, and a plurality of connector members having opposed end portions attached to the plurality of coupling and the opposed ends of the plurality of platforms respectively. The plurality of platforms are selectively operable between upper and lower positions as the plurality of motors drive the plurality of gears and cause the plurality of worm gears to rotate in a cooperating direction for directing said plurality of couplings to move along respective lengths of said plurality of worm gears. The plurality of gears may include respective beveled portions integral therewith.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout, and prime and double prime notations are used to indicate similar elements in alternate embodiments.

Figure 1:
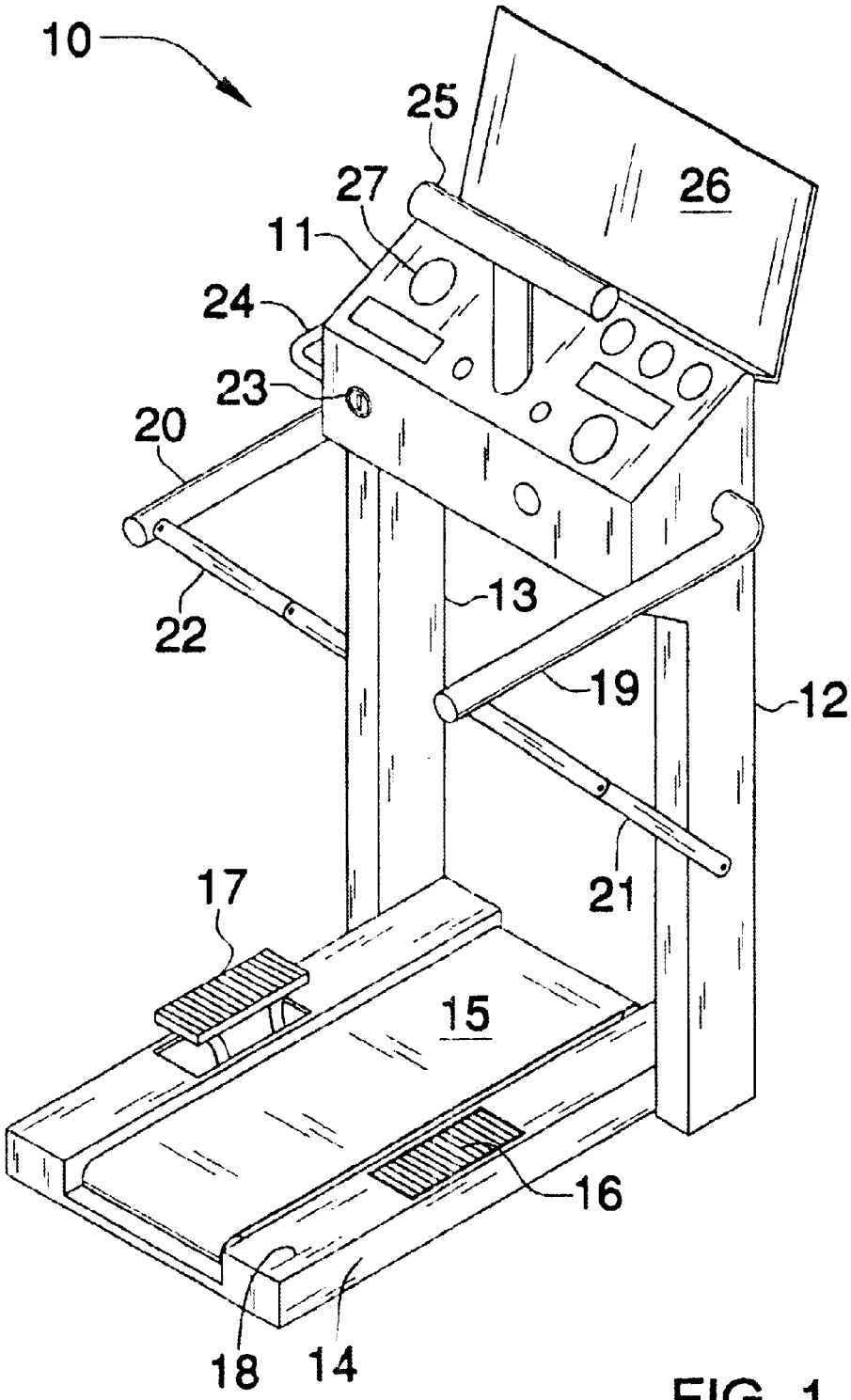
FIG. 1 is a perspective view showing a treadmill including a pluarlity of adjustable platforms, in accordance with the present invention.

The treadmill of this invention is referred to generally in FIG. 1 by the reference numeral 10 and is intended to allow a user to exercise one leg at a time, similar to riding a conventional scooter. It should be understood that the treadmill 10 may be used for extracurricular activities as well as rehabilitative activities. The treadmill 10 includes an upper portion defined by the control panel 11. The pair of side post 12, 13 each have an upper end portion connected to the control panel 11 and extend substantially vertically downward therefrom to ground level. The base 14 having a front-end portion is disposed between the pair of side post 12, 13 and his connected thereto. The base 14 extends rearwardly from approximately the front end of the treadmill 10.

The treadmill further includes a pair of handrails 19, 20 connected to exterior sides of the side post 12, 13. In particular, handrails 19, 20 are connected to the respective upper end portions of side posts 12, 13. Each handrail 19, 20 has a pivoting end connected to the side post 12, 13, respectively, for allowing the handrails 19, 20 to be pivoted between operable and non-operable positions. For supporting the handrails 19, 20 at operable positions, linking members 21, 22 are attached at rearward ends of handrails 19, 20, respectively, and extend downwardly to generally the medial portion of side posts 12, 13 and are connected thereto by a conventional fastener.

Each linking member 21, 22 includes first and second portions connected to one another at a common end as is clearly shown in FIG. 1. Accordingly, as handrails 19, 20 are moved between operable and non-operable positions, the linking members 21, 22 are movable between extended and retracted or bent positions, respectively, as perhaps better shown in FIG. 3.

The treadmill 10 further includes a pair of platforms 16, 17 or scooter pads disposed generally medially between the foreword end and rearward end of the base 14. Such platforms 16, 17 are spaced apart at opposite sides of base 14. The treadmill belt 15 is disposed between such platforms 16, 17 and is rotated by an assembly (not shown) in a conventional manner as readily known in the industry. Of course, the treadmill belts 15 may be adjusted to incline at different angles.

A magazine holder 26 may be connected to the front end of the control panel 11 and extends generally upwardly therefrom. Such a magazine holder 26 extends the width of treadmill 10 and includes a downwardly sloping portion for receiving magazines thereon. The control panel 11 includes a handle 25 having a generally t-shape and connected thereto and extending generally upwardly therefrom. Such a handle 25 may be gripped by a user while exercising on the machine for providing support and balance. Handle 25 preferably includes a hand break lever (not shown) that is wired to the speed control of the treadmill 10. This would allow a user to slow or stop the treadmill belts 15 as desired. The control panel 11 may further include a plurality of buttons such as an auto off button 27 and a key start button 23 for turning the treadmill 10 on and off.

Figure 2:
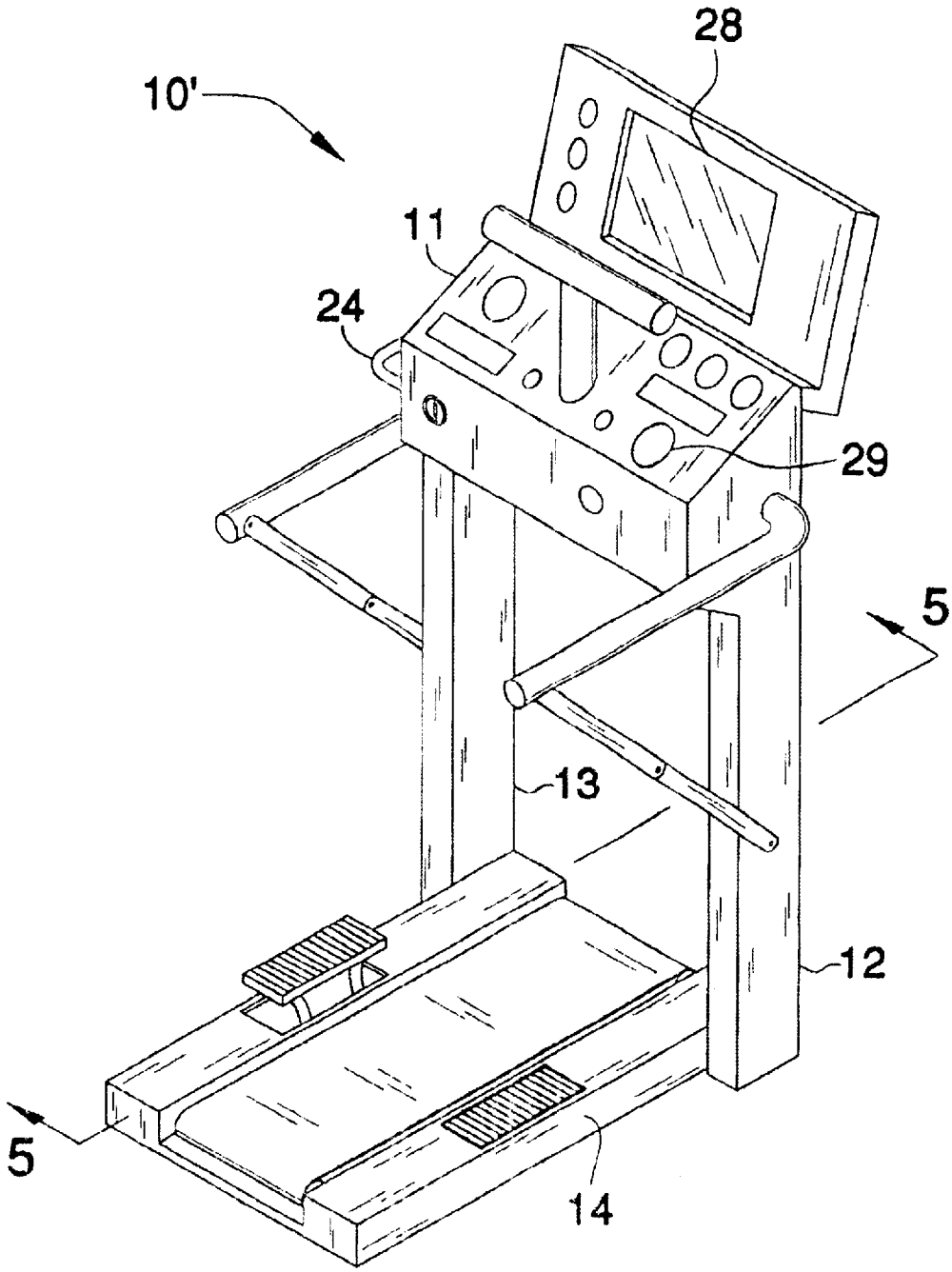
FIG. 2 is a perspective view of an alternate embodiment of the treadmill shown in FIG. 1.

Now referring to the FIG. 2, an alternate embodiment 10' of the present invention is shown. Such an embodiment 10' includes a display screen 28 connected to the control panel 11 and extends generally upwardly therefrom. Such a display screen 28 illustrates data and symbols for visually depicting select operating modes of the treadmill 10'. Control panel 11 allows the user to adjust the speed and incline of the treadmill belt 15. Such a control panel 11 preferably includes a mileage/distance counter, speed odometer, calorie counter and touch-sensitive, pulse reading device. The display screen 28 displays a scooter moving through outdoor scenery while a user is exercising on the treadmill 10.

A cup holder 29 is also provided at the control panel 11. The treadmill 10' further includes a towel holder 24 connected at the upper portion and adjacent to control panel 11. Such a towel holder 24 preferably extends laterally outward from treadmill 10'.

A pair of conventional brackets (not shown) connect the outer edges of base 14 to the inner edge portions of side posts 12, 13. Accordingly, as will be readily known to a person of ordinary skill in the art, base 14 may be selectively pivoted between up and down positions corresponding to non-operating and operating positions. FIG. 2 illustrates an operating position and FIG. 3 illustrates a non-operating position.

Figure 3:
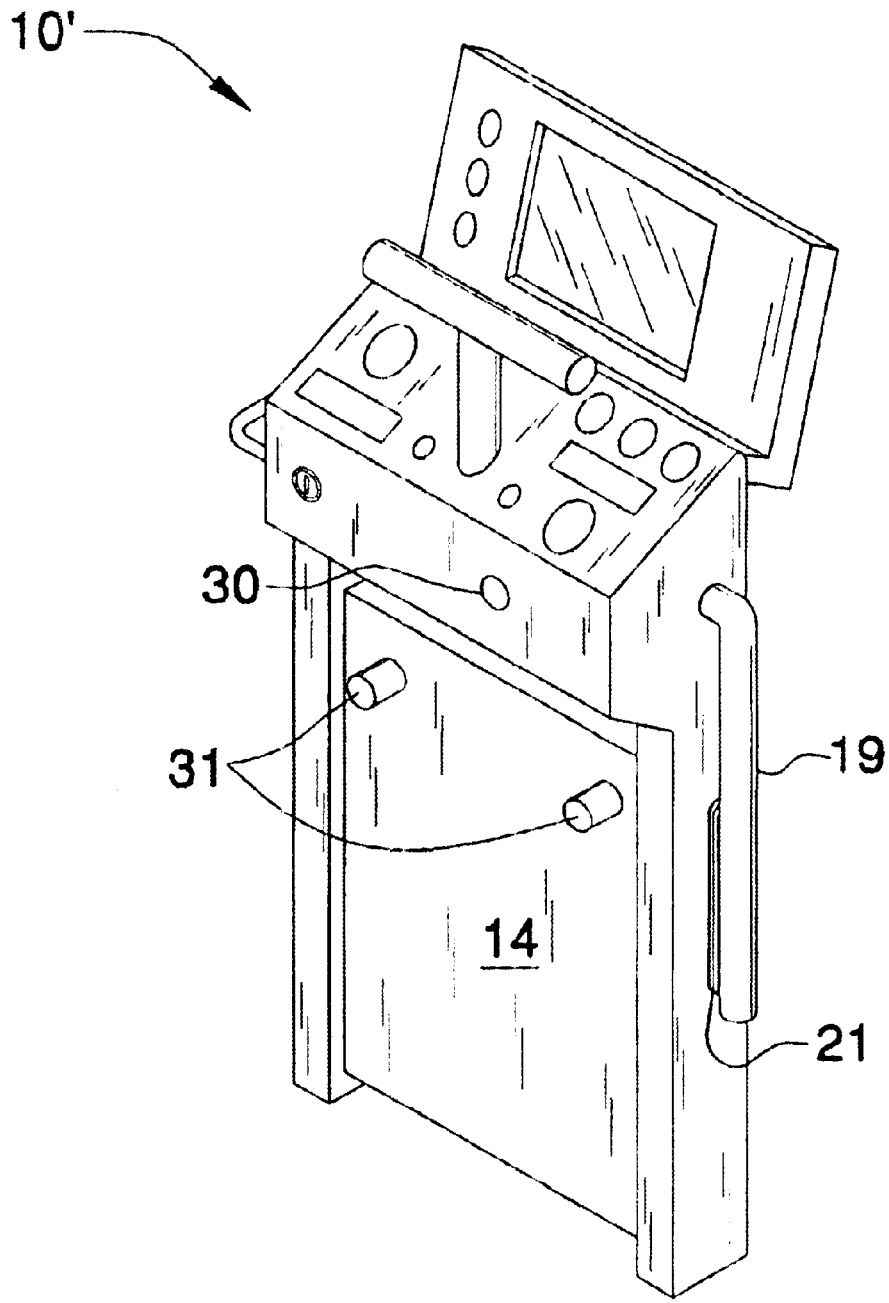
FIG. 3 is a perspective view of FIG. 2, showing the treadmill at an up position.

Now referring to FIG. 3, the treadmill 10' is shown as including an up/down button for controlling the movement of base 14 between operating and non-operating positions. A pair of legs 31 are spaced apart and attached at opposite side portions to the bottom side of base 14. Such legs 31 are attached at a rearward portion of the base 14 for supporting and maintaining the base 14 above ground when in an operating position.

Figure 4:
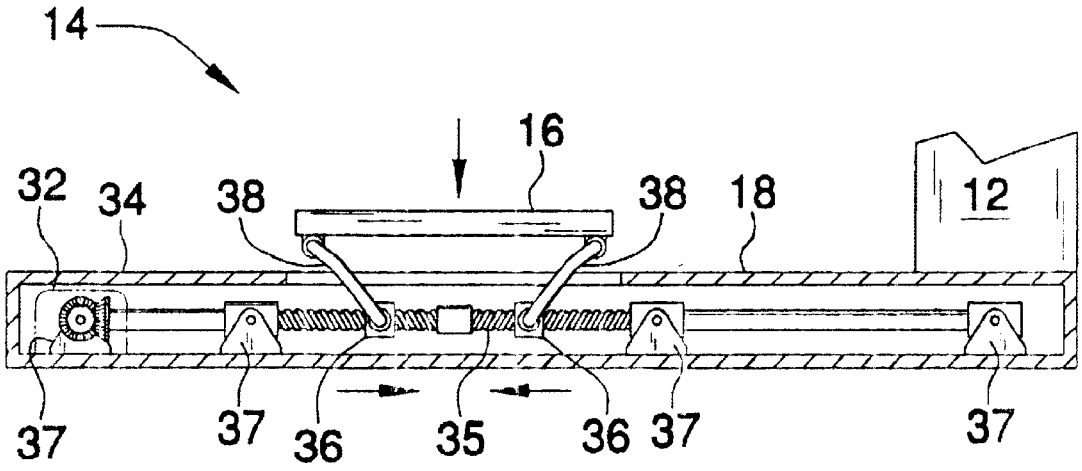
FIG. 4 is an enlarged cross-sectional view of the treadmill base showing the means for operating the adjustable platforms thereof.

Now referring to FIG. 4, a cross-sectional view of base 14 shows the assembly for operating the pair of platforms 16, 17. Of course, it should be understood that platforms 16, 17 are operated in substantially similar manners. Therefore, for simplicity, only platform 16 and its operation will be discussed herein below. As can be seen in FIG. 4, platform 16 is at a raised position and is supported thereat by a pair of couplings 36 and linking members 38 for attaching platform 16 to couplings 36. The drive motor 32 is disposed within base 14 and is housed therein by cover member 18. Such a drive motor 32 is positioned at a rearward portion of base 14. The drive motor 32 powers gears 34, which in turn rotate a worm gear 35 in a corresponding direction.

Gears 34 are preferably beveled gears as readily known to a person of ordinary skill in the art. Thus, gears 34 have a slanting portion joining each other at an angle that is not a right angle. Furthermore, a bracket 37 that is connected to base 14 supports such gears 34. Worm gear 35 is a conventional warm gear including helical threads along its shaft. In particular, the helical threads mesh with corresponding threaded portions of couplings 36 for causing same to move in cooperating directions. In particular, as the couplings 36 movement toward one another, platform 16 is caused to move downwardly. Conversely, as couplings 36 are caused to move away from each other, platform 16 is caused to move upwardly. Of course, the directional rotation of worm gear 35 controls the movement of couplings 36.

Linking members 38 are connected to platforms 16 and couplings 36 at opposite ends via corresponding bearings. Such bearings are conventional bearings and house opposed ends of the linking members 38 for supporting and allowing same to rotate thereat as the couplings 36 travel along the length of worm gear 35. For further providing support to the worm gear 35, a plurality of support brackets 37 are connected thereto and spaced along its shaft for connecting the worm gear 35 to base 14.

Figure 5:
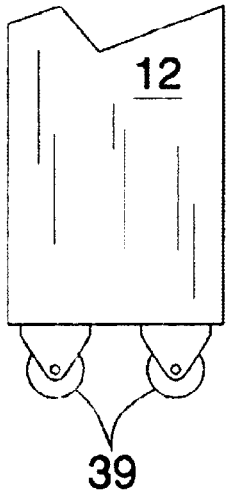
FIG. 5 is an enlarged, partial view of the treadmill side post connected to a plurality of wheels.

Now referring to FIG. 5, a portion of side post 12 is shown as having a plurality of wheels 39 connected to the lower portion thereof. Such wheels 39 are preferably castor wheels and are connected to side posts 12 via a pair of conventional brackets. Accordingly, after treadmill 10 has been move to a non-operating position, the treadmill 10 may be transferred to different locations via wheels 39.

Figure 6:
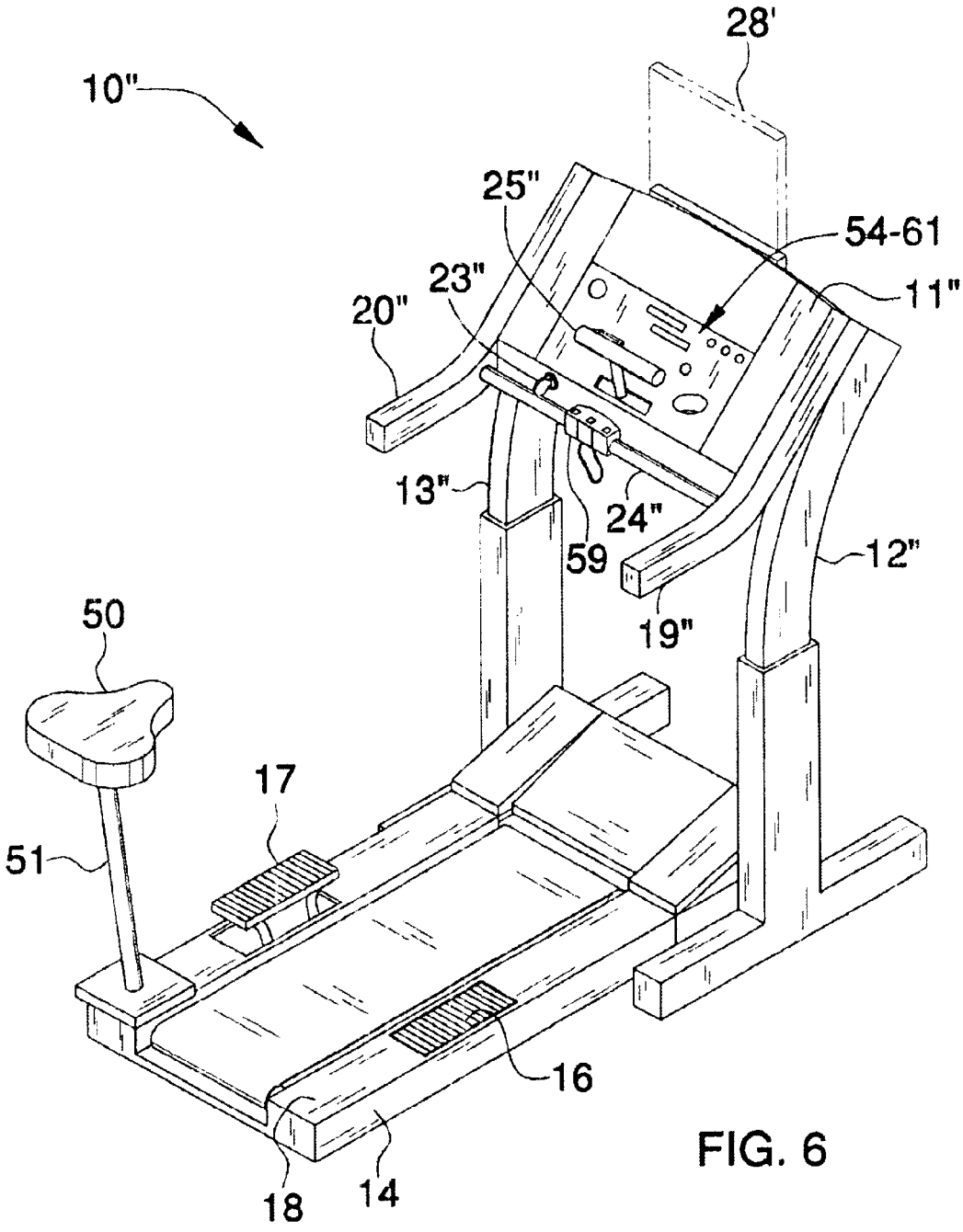
FIG. 6 is a perspective view showing an alternate embodiment of the present invention at an open position.
Figure 7:
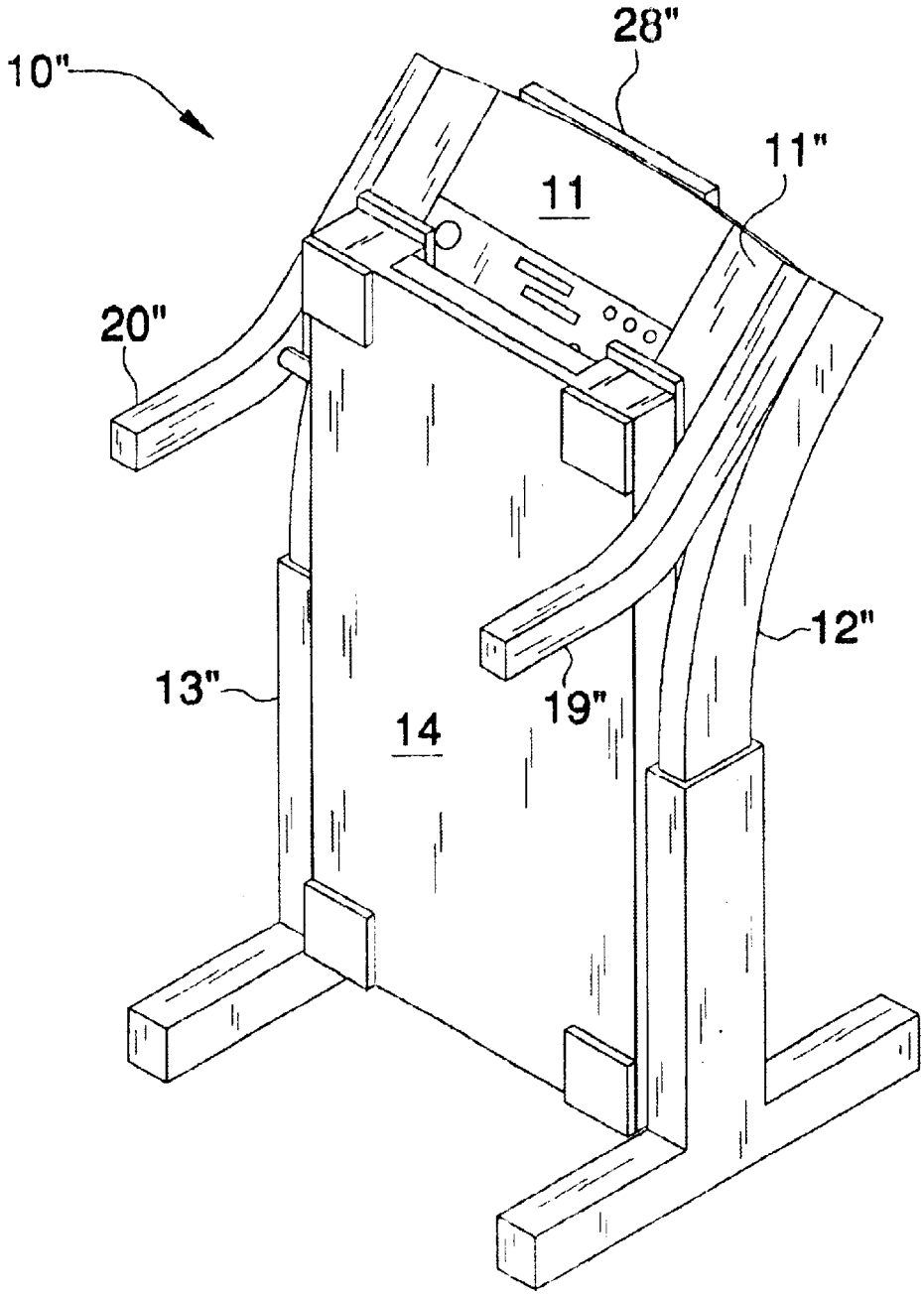
FIG. 7 is a perspective view thereof at a closed position.

Now referring to FIGS. 6 and 7, an alternate embodiment 10" of the treadmill 10 is shown as including a seat 50 having an elongate support rod 51 connected thereto at one end portion and connected to the base 14" at an opposed end portion. The seat 50 can be removably positioned at opposite sides of the base 14" and the height thereof may be adjusted to accommodate different users. Advantageously, a user may sit on seat 50 while exercising his/her leg(s) on the treadmill 10".

The treadmill 10" may further include a telephone 52 or telephone holder 53 so that a user can quickly and easily contact emergency personnel during emergencies. The control panel 11" includes a display screen 28" that slides thereunder for storage. The control panel 11" may further include speed/incline buttons 54, a mileage/distance counter 55, speedometer 56, calorie counter 58, touch-sensitive pulse-reading devices 59 (as well known in the art), a "911" or emergency button 60, and on/off control buttons 60, 61 for each platform 16, 17, respectively.

The "911" or emergency button 60 may be incorporated into the control panel 11" and may function by either wireless communication technology or a hard wired line connected to a home telephone jack, as readily known to the person of ordinary skill in the art. In addition, the handle 25" may be operably connected to a brake lever (not shown) so that a user can quickly and easily adjust the speed of the treadmill via moving the handle 25" in an appropriate direction.

In operation, with platform 16 or 17 at a raised position, a user can exercise on the treadmill 10 in a manner similar to riding a conventional kick scooter. Of course, treadmill 10 may be used in a conventional manner for walking or jogging with platforms 16, 17 at their down or stowed position. To turn on treadmill 10, a user must first engage key start button 23 via a corresponding key. Once power has been supplied to the treadmill 10, a user can simply step on the treadmill and activate the motor and belts 15 via control panel 11.

Advantageously, a user may also engage platforms 16, 17 disposed on either side of the treadmill 10 and use same as through he/she was riding a conventional kick scooter. In particular, a user could raise one platform 16 or 17 to a desired height, place a corresponding foot on the platform, and push on the treadmill belt 15 with the other foot. After several minutes, the platform 16 or 17 could be lowered and the opposite platform 16 or 17 raised. This allows a user to push off the treadmill belt 15 using the other leg. In this regard, treadmill 10 may be ideal for providing a mild workout for older individuals, as well as handicapped individuals and rehabilitation patients recovering from injury or surgery.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A treadmill comprising:

a control panel for receiving user input;

a plurality of side posts including respective upper portions connected to said control panel and extending downwardly therefrom to ground level, said side posts further including respective lower portions;

a base including a front end connected between said pair of side posts and extending rearwardly from said respective lower portions thereof;

a treadmill belt connected to said base and being selectively operable by a user;

means for selectively operating said treadmill belt and being connected to said base;

a plurality of platforms spaced apart and disposed on opposite sides of said base, said plurality of platforms having opposed end portions; and means for selectively elevating said plurality of platforms to a static position and being connected to said base whereby a user can place one leg on a static platform while exercising the opposite leg on the treadmill belt.

2. The treadmill of claim 1, further comprising a plurality of handrails connected to said upper portion of each said side post and extending rearwardly therefrom, said hand rails including rearward ends respectively.

3. The treadmill of claim 1, further comprising:

a handle connected to said control panel and extending upwardly therefrom; and a brake lever connected to said handle and operable therewith for adjusting the speed of said treadmill.

4. The treadmill of claim 1, further comprising a telephone holder attached to said control panel so that a telephone may be placed thereon and operated without requiring a user to get off said treadmill.

5. The treadmill of claim 1, further comprising a display screen connected to said control panel and for displaying visual data and symbols corresponding to an operating mode of said treadmill, said display screen being movable beneath said control panel for storage.

6. The treadmill of claim 1, wherein said control panel comprises means for automatically stopping the treadmill when pressed by a user.

7. The treadmill of claim 1, wherein the control panel further comprises means for toggling said treadmill between operating and non-operating modes.

8. The treadmill of claim 2, further comprising a plurality of linking members having opposite ends attached to generally medially of said plurality of side posts and said rearwards end of said plurality of hand rails respectively, said plurality of linking members each having first and second elongate portions connected at respective ends, said first and second members being movable between bent and extended positions when said plurality of hand rails are moved between corresponding non-operable and operable positions.

9. The treadmill of claim 1, further comprising a plurality of brackets for connecting said front end of said base to said lower portions of said plurality of side posts respectively, said base being pivotable at said bracket for moving said base between operable and non-operable positions.

10. The treadmill of claim 1, further comprising a plurality of wheels connected to said lower portions of said plurality of side posts respectively, said wheels allowing said treadmill to be rolled thereon.

11. The treadmill of claim 1, wherein said means for selectively operating said plurality of platforms comprises:

a plurality of drive motors;

a plurality of gears connected to said plurality of drive motors respectively;

a plurality of elongate worm gears connected to said plurality of gears respectively;

a plurality of couplings movably disposed along a length of said plurality of worm gears; and a plurality of connector members having opposed end portions attached to said plurality of coupling and the opposed ends of said plurality of platforms respectively, said plurality of platforms being selectively operable between upper and lower positions as said plurality of motors drive said plurality of gears and cause said plurality of worm gears to rotate in a cooperating direction for directing said plurality of couplings to move along respective lengths of said plurality of worm gears.

12. The treadmill of claim 13, wherein said plurality of gears include respective beveled portions integral therewith.

13. The treadmill of claim 1, further comprising a seat including an elongate support rod having opposed end portions removably connected to said seat and said base portion respectively so that a user may sit on said seat while exercising on said treadmill.

14. A treadmill comprising:

a control panel for receiving user input;

a plurality of side posts including respective upper portions connected to said control panel and extending downwardly therefrom to ground level, said side posts further including respective lower portions;

a base including a front end connected between said pair of side posts and extending rearwardly from said respective lower portions thereof;

a treadmill belt connected to said base and being selectively operable by a user;

an assembly for selectively operating said treadmill belt and being connected to said base;

a plurality of platforms space apart and disposed on opposite sides of said base, said plurality of platforms having opposed end portions; and an assembly for selectively operating said plurality of platforms and being connected to said base, said assembly including a plurality of drive motors;

a plurality of gears connected to said plurality of drive motors respectively;

a plurality of elongate worm gears connected to said plurality of gears respectively;

a plurality of couplings movably disposed along a length of said plurality of worm gears; and a plurality of connector members having opposed end portions attached to said plurality of coupling and the opposed ends of said plurality of platforms respectively, said plurality of platforms being selectively operable between upper and lower static positions as said plurality of motors drive said plurality of gears and cause said plurality of worm gears to rotate in a cooperating direction for directing said plurality of couplings to move along respective lengths of said plurality of worm gears.

15. The treadmill of claim 14, further comprising a plurality of handrails connected to said upper portion of each said side post and extending rearwardly therefrom, said hand rails including rearward ends respectively.

16. The treadmill of claim 14, wherein said plurality of gears include respective beveled portions integral therewith.

17. The treadmill of claim 14, further comprising a plurality of linking members having opposite ends attached to generally medially of said plurality of side posts and said rearwards end of said plurality of hand rails respectively, said plurality of linking members each having first and second elongate portions connected at respective ends, said first and second members being movable between bent and extended positions when said plurality of hand rails are moved between corresponding non-operable and operable positions.

18. The treadmill of claim 14, further comprising a plurality of brackets for connecting said front end of said base to said lower portions of said plurality of side posts respectively, said base being pivotable at said bracket for moving said base between operable and non-operable positions.

19. The treadmill of claim 14, further comprising a display screen connected to said control panel and for displaying visual data and symbols corresponding to an operating mode of said treadmill, said display screen being movable beneath said control panel for storage.

20. The treadmill of claim 14, further comprising a seat including an elongate support rod having opposed end portions removably connected to said seat and said base portion respectively so that a user may sit on said seat while exercising on said treadmill.

* * * * *